US005595126A

United States Patent [19]

Yeh

[11] Patent Number: 5,595,126

[45] Date of Patent: Jan. 21, 1997

[54] SHAPE-CHANGEABLE TABLE

[76] Inventor: Hsin-Ho Yeh, 2F, No. 1, Lane 3, Chen Der Road, Section 4, Shih Lin, Taipei, Taiwan

[21] Appl. No.: 513,505

[22] Filed: Aug. 10, 1995

[51] Int. Cl.[6] ..... A47B 1/00

[52] U.S. Cl. ..... 108/64; 108/65; 108/90; 403/294

[58] Field of Search ..... 108/11, 64, 65, 108/69, 83, 90, 185; 403/294, 298, 292, 295, 293, 384

[56] References Cited

U.S. PATENT DOCUMENTS

| | | | |
|---|---|---|---|
| 3,313,199 | 4/1967 | Houvener et al. | 403/292 X |
| 4,531,564 | 7/1985 | Hanna | 160/229.1 X |
| 4,701,066 | 10/1987 | Beam et al. | 403/298 |

FOREIGN PATENT DOCUMENTS

| | | | |
|---|---|---|---|
| 228777 | 6/1960 | Australia | 403/298 |
| 354149 | 2/1990 | European Pat. Off. | 403/294 |
| 3610232 | 10/1987 | Germany | 108/64 |
| 3902926 | 4/1990 | Germany | 108/64 |
| 1320699 | 6/1973 | United Kingdom | 108/65 |
| 93024035 | 12/1993 | WIPO | 108/64 |

*Primary Examiner*—Peter M. Cuomo
*Assistant Examiner*—Hanh V. Tran
*Attorney, Agent, or Firm*—Bacon & Thomas

[57] ABSTRACT

A table consists of a plurality of individually formed units. Each of the units has a table top of different geometric shape such that a user may disassemble the table to individual units and freely fit the units together again in any desired manner, so as to form one or more new tables having differently shaped tops depending on the space requirements.

3 Claims, 4 Drawing Sheets

SHAPE-CHANGEABLE TABLE

BACKGROUND OF THE INVENTION

FIGS. 1 and 2 illutstrate two examples of conventional tables which usually have a fixed shaped table top and one or more legs for supporting the table top and allowing the whole table to stably stand on the ground or floor. Consumers usually have to consider the space and the actual need they have before they can make any decision on purchasing a desired table. However, tables with fixed shape and dimensions may not necessarily meet the user's requirements once the need or the room space of the user has is changed. It is obviously a waste if the table is discarded due to such changes.

SUMMARY OF THE INVENTION

It is therefore a primary object of the present invention to provide a shape-changeable table which has a simplified structure and consists of a plurality of differently shaped units for freely and easily fitting together to form one or more tables with differently shaped tops to meet the user's current requirements.

The shape-changeable table according to the present invention mainly consists of a plurality of individually formed units. Each unit may have a differently shaped table top. Each unit's table top is formed at every side face at the same height with a transversely extended recess in which multiple mortises with adequate depth are further formed at equal intervals. Tenons are correspondingly provided to match with these recesses and mortises so that the individual table units can be associated with one another by engaging the mortises or recesses and corresponding tenons to form a new table having a planar, smooth, and larger table top. The user may freely associate any unit with any other unit or units depending on his or her own requirement or on the spatial restriction. The units may be associated to form one single table or two or more independent smaller tables as required.

BREIF DESCRIPTION OF THE DRAWINGS

Figure 6:
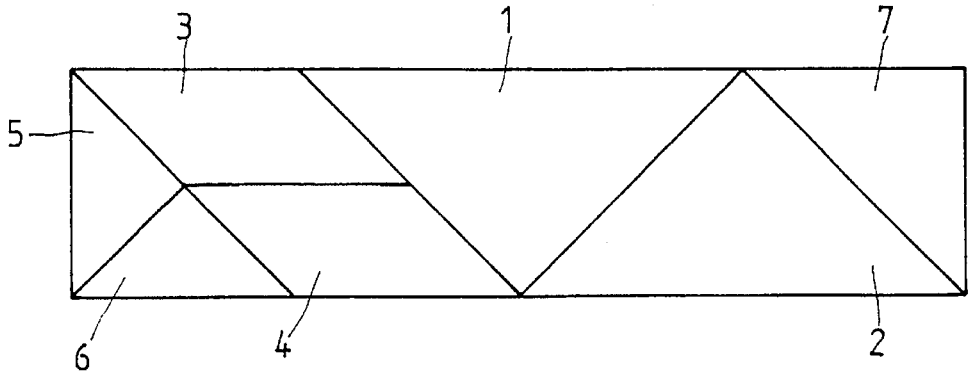
Figure 7:
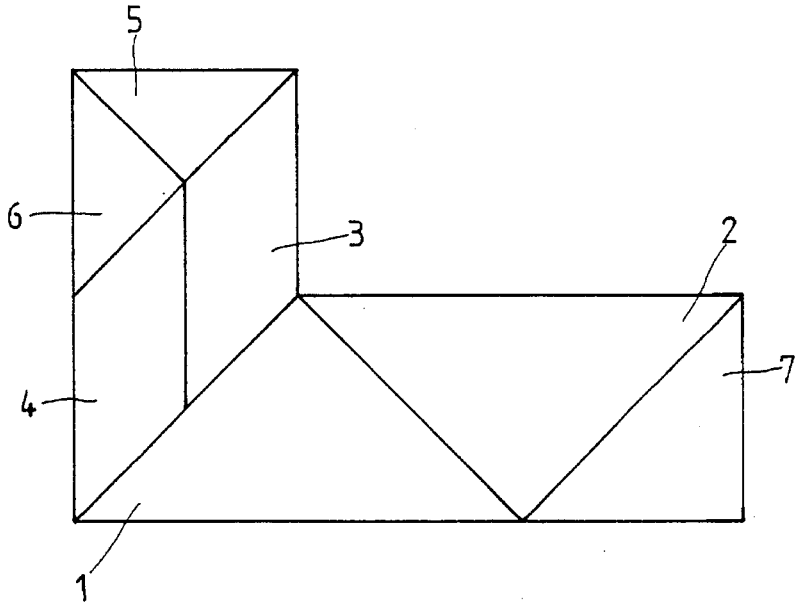
Figure 8:
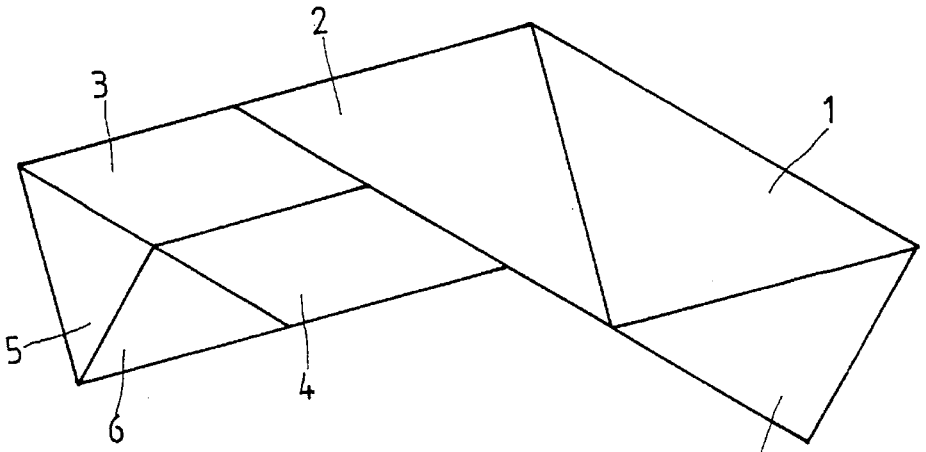
Figure 9:
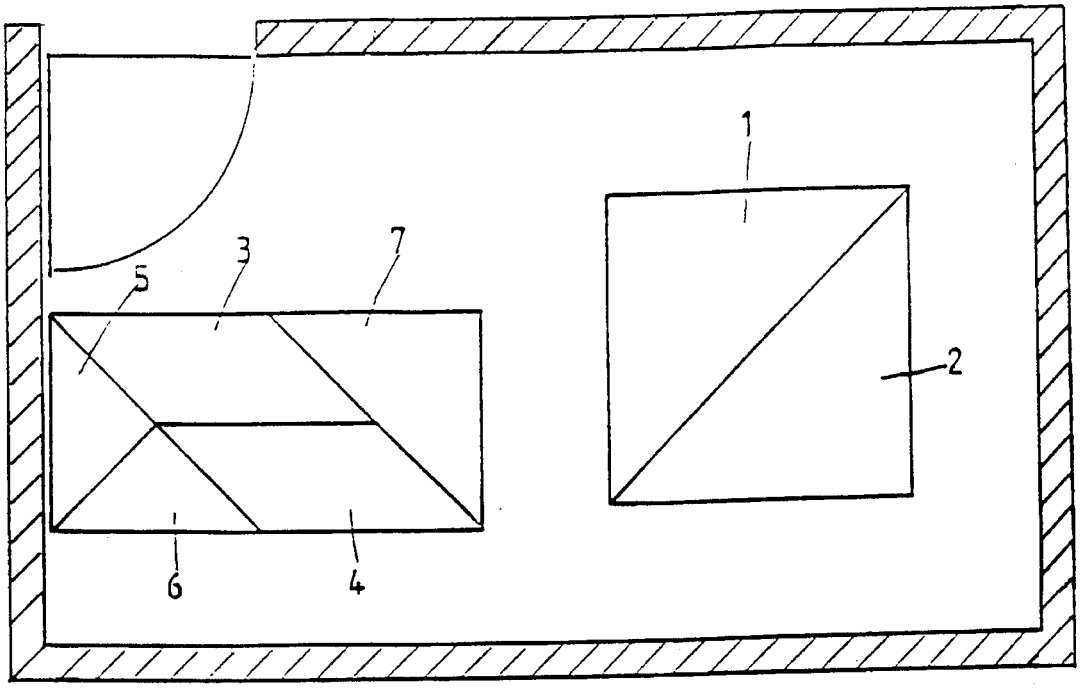
Figure 10:
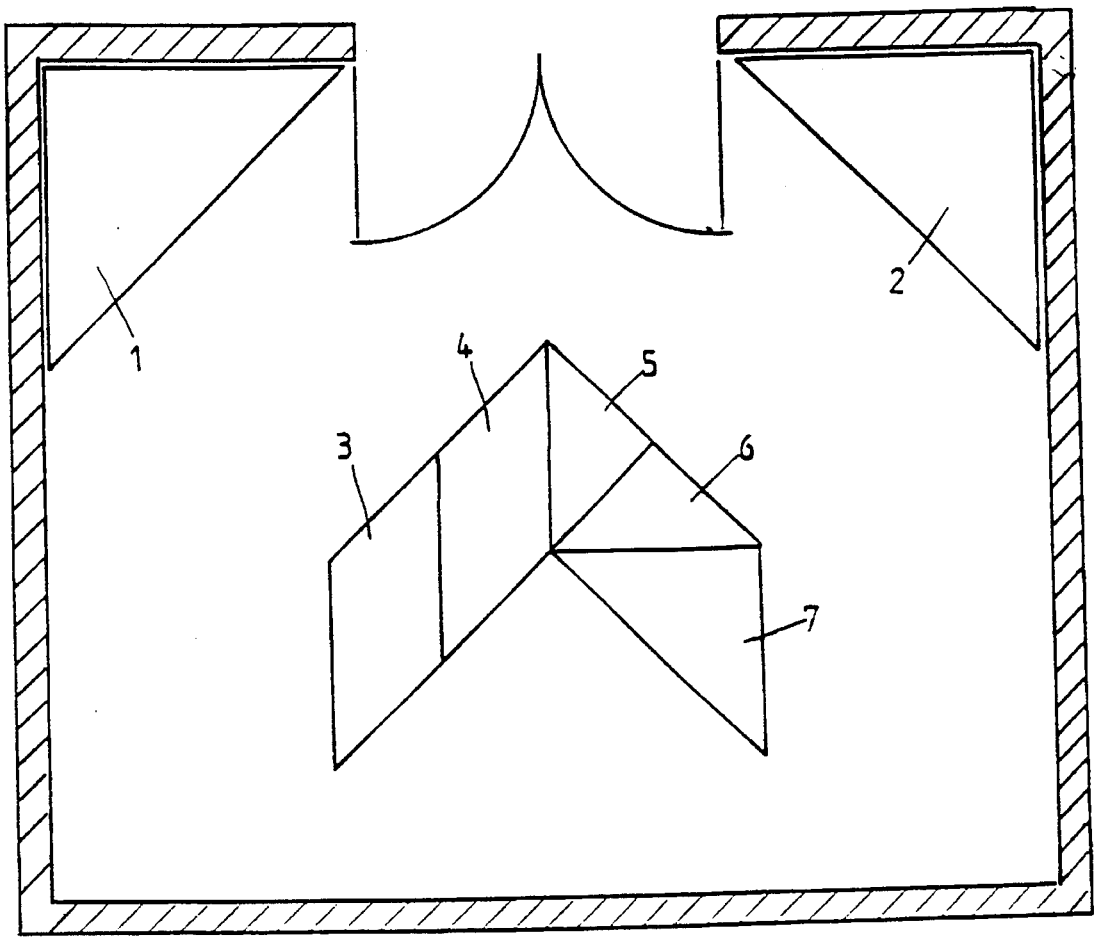

FIGS. 6, 7, and 8 are top plan views illustrating various table tops differently formed from the association of different units with one another; and FIGS. 9 and 10 are top plan views illustrating two or more table tops differently formed from one or more units of the present invention to meet the existing room space.

DETAILED DESCRIPTION OF THE PREFERRED EMBODIMENTS

Figure 1:
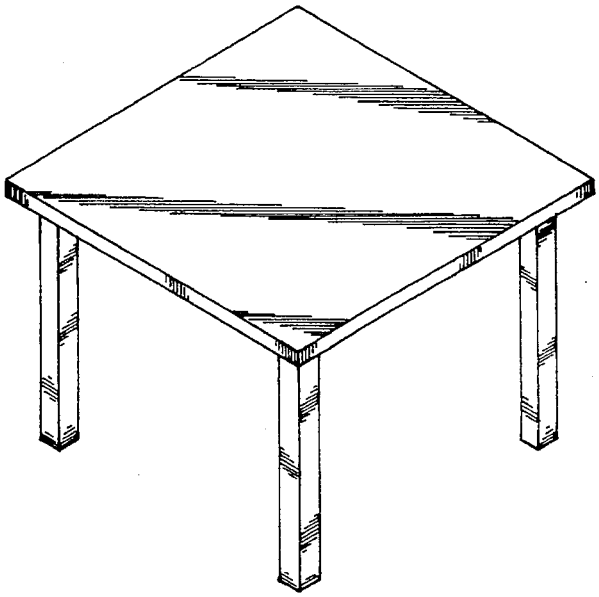
FIG. 1 PRIOR ART
FIGS. 1 and 2 illustrate two examples of conventional tables having fixed shaped table tops.
Figure 2:
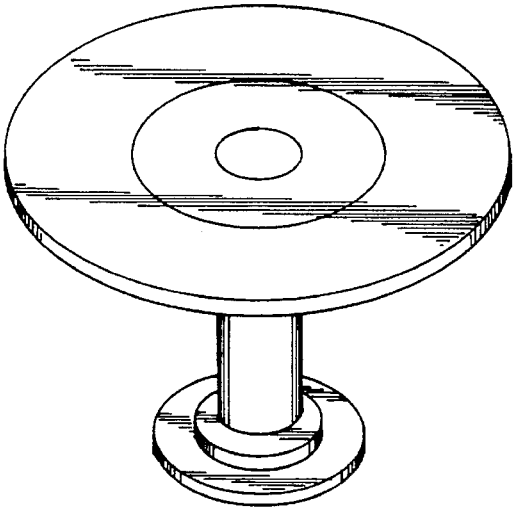
FIG. 2 PRIOR ART
Figure 3:
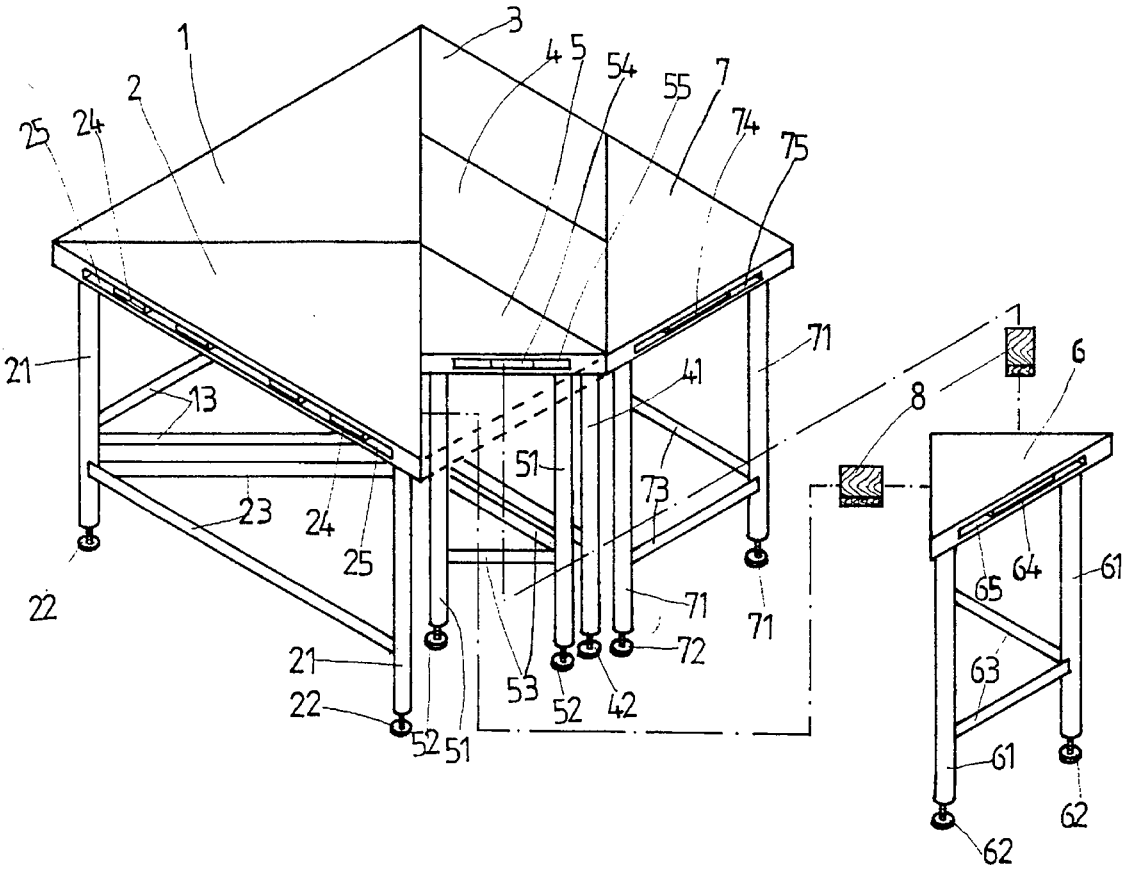
FIG. 3 is a partially disassembled perspective view showing an embodiment of the table according to the present invention in which several units are fitted together to form a whole table top.

Please refer to FIG. 3. The present invention relates to a shape-changeable table which consists of a plurality of individually formed table units. In a preferred embodiment as illustrated in FIG. 3, there are seven units which are separately designated as unit 1, 2, 3, 4, 5, 6, and 7. Each of such units has a table top of different geometric shape. Legs 21, 41, 51, 61, 71 are respectively provided to each corner and extend from the bottom surfaces of the table units 1, 2, 3, 4, 5, 6, and 7. Adjusting means 22, 42, 52, 62, 72 are adjustably screwed to a lower end of each leg 11, 21, 31, 41, 51, 61, 71, respectively, so that the length of each leg can be separately adjusted by turning its corresponding adjusting means and thereby ensures the stable position of each leg and each unit on the ground or the floor. Reinforcing struts 13, 23, 53, 63, 73 are provided to extend between every two legs of each unit to further enhance the upright and stable position of the legs.

Figure 4:
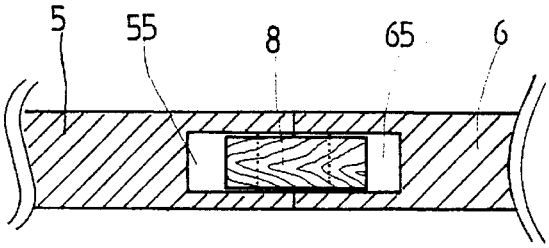
FIGS. 4 and 5 are fragmentary, enlarged, sectional views showing the engagement of a recess or mortise with a tenon.
Figure 5:
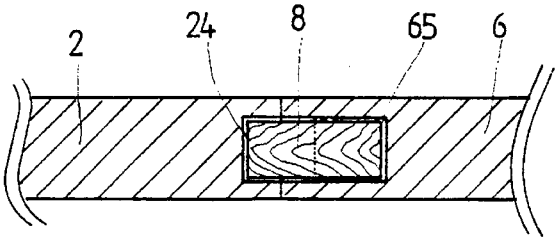

Each unit is of a planar polygonal configuration and provided at each peripheral side face of the table top at the same height with a longitudinal recess 24, 54, 64, or 74. And, multiple mortises 25, 55, 65, 75 with predetermined depth are respectively formed in corresponding recesses at equal intervals. A plurality of tenons 8 are also provided on the peripheral side faces corresponding to those recesses or mortises so that the table tops of any two units can be fitted together to dispose the side faces in abutting relationship with each other and the top surfaces of the units are disposed in a coplanar relationship to collectively define larger table top by engaging their respective tenons 8 with the recesses or mortises, as shown in FIGS. 4 and 5.

With the recesses, mortises, and tenons, the units can be freely fitted together by the user to form a table having a top of any desired shape as required, as shown in FIGS. 6, 7, and 8. When the room in which the table is to be positioned has special dimensions, or the user has unique idea about the fitting of different units, more than one table can be formed from the units to meet the special requirement, such as illustrated in FIGS. 9 and 10. In brief, the user may freely use these differently shaped table units to form any new table or tables by disassembling the units and re-assembling them at any time.

To enable the table units to be freely fitted together in any desired manner, and to enable the disassembled table units to be more conveniently packed with reduced volume, the legs and the reinforcing struts thereof all can be designed to be detachably connected to the table tops by means of threads, screws or tenons and mortises. With such disassembled and reduced-volume table units and parts thereof, the table of the present invention can be purchased through mail order and meet the DIY requirement.

What is claimed is:

1. A shape-changeable table comprising:

a) a plurality of individual table units, each table unit being of a planar polygonal configuration defined in part by a top surface and a plurality of peripheral side faces;

b) at least one peripheral side face of each table unit being provided with a longitudinal recess formed therein and at least one mortise disposed in the longitudinal recess; and c) a plurality of tenons engageable with the recesses and mortises of adjacent table units for securing the units together and disposing the side faces of adjacent units in abutting relationship with each other, whereby the top surfaces of the units are disposed in a coplanar relationship with each other for collectively defining a table top.

2. The table of claim 1 wherein each table unit includes a bottom surface and a plurality of legs extending from the bottom surfaces of the table units for supporting same in a raised position.

3. The table of claim 2 wherein each leg further includes means for adjusting the length of the leg.

* * * * *